United States Patent [19]

Overgard

[11] Patent Number: 4,697,304

[45] Date of Patent: Oct. 6, 1987

[54] FRICTION CONTROLLED WINDOW BALANCE

[75] Inventor: Bruce L. Overgard, Colton, S. Dak.

[73] Assignee: The Celotex Corporation, Tampa, Fla.

[21] Appl. No.: 884,812

[22] Filed: Jul. 11, 1986

[51] Int. Cl.[4] ..... E05F 1/16

[52] U.S. Cl. ..... 16/198; 16/214; 49/445

[58] Field of Search ..... 16/198, 199, DIG. 16, 16/DIG. 20, 196, 197, 210, 215, 212, 214; 49/445, 446, 404

[56] References Cited

U.S. PATENT DOCUMENTS 395,165 12/1888 Morgan ..... 16/198

2,294,851 9/1942 Owen ..... 49/445

*Primary Examiner*—Nicholas P. Godici

*Assistant Examiner*—G. M. Reid

*Attorney, Agent, or Firm*—James W. Grace; Charles W. Vanecek

[57] ABSTRACT

This invention relates to a window sash balance of the coil spring and cord type in which a friction drag element is in frictional contact with multiple lengths of loops of said cord.

3 Claims, 2 Drawing Figures

FRICTION CONTROLLED WINDOW BALANCE

BACKGROUND OF THE INVENTION

1. Field of the Invention

This invention relates to a window sash balance or counterbalance structure and more particularly to an improved window balance assembly especially adapted for balancing windows which may fall in a range of different weights.

2. Description of the Prior Art

Balance assemblies for various window constructions have taken many varied and complex forms. This is particularly true in connection with preformed and prehung window constructions. The simplified balance assembly which utilizes springs instead of weights has been incorporated into both the prehung and conventional window construction. Such balance assemblies, however, have not been able to satisfactorily counterbalance windows which fall into a wide range of different weights. A conventional window balance may be used to balance windows through a narrow range of different weights. For example, a particular window balance of the prior art may be used to balance windows weighing from 4 through 6 pounds inclusive, a range of 3 pounds. If this range can be increased to cover a range of 6 pounds, the inventory of balances carried by a manufacturer of window assemblies can be reduced by half. Because the window balance must be the same length as the window being balanced, a manufacturer of window assemblies must have a large inventory of balances. If the inventory can be cut in half, the manufacturer will save both money and storage area.

In the past, friction has been used as an element in controlling the balancing of windows. U. S. Pat. No. 3,358,403, owned by The Celotex Corporation, discloses a window balance assembly which uses nonrotatable grooved guide members over which the free extremity of the cord extends in frictional engagement with one of the grooved guide members. While the use of a nonrotatable grooved guide member enables the balance assembly to compensate for a range of window weights, it has been found to be complex to assemble because it requires multiple parts and is thus more expensive to manufacture. In addition, the range of window weights to be balanced has been found to be comparatively narrow.

In at least one configuration of this prior art window balance, the cord is bent at 180° around one of the nonrotatable grooved guide members and the amount of friction becomes too great to permit easy opening and closing of the window.

SUMMARY OF THE INVENTION

The present invention is directed to an improved window balance which covers an increased range of window weights which can be balanced. This is accomplished without increasing the physical dimensions of the spring operated balance units but by means of a simple friction element. The friction element is cheap to manufacture and install and constitutes but one additional element.

OBJECTS OF THE INVENTION

It is an object of the invention to provide a novel window balance assembly which includes a friction element to enable the window balance to be used with windows having a wide range of weights.

It is another object of the invention to provide a novel window balance assembly which is easy to assemble with a minimum of additional components.

BRIEF DESCRIPTION OF THE DRAWING

Other objects and advantages of the present invention will become apparent to those skilled in the art from the following detailed description of the invention taken in conjunction with the accompanying drawing in which like elements are represented by like numerals and in which.

DESCRIPTION OF THE PREFERRED EMBODIMENT

Figure 1:
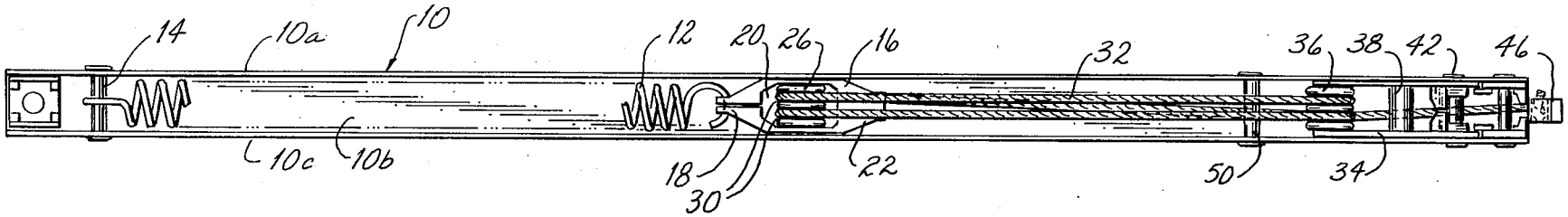
FIG. 1 is a top elevational view of the window balance assembly of the present invention.
Figure 2:
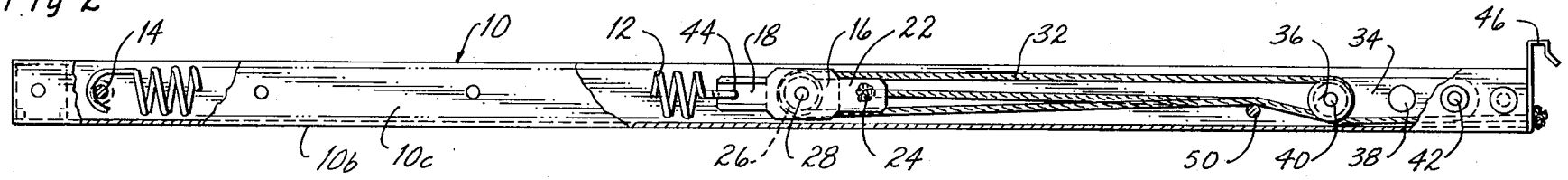
FIG. 2 is a cut-away side view of the window balance assembly of the present invention.

Referring to FIG. 1 of the drawing there is shown a balance unit comprising an elongated U-shaped channel member 10 having an open top area, two sidewalls 10*a*, and 10*c* and a bottom wall 10*b*. In the trough of the U-shaped channel is the main window balance assembly comprising a coil spring 12 which fits within the confines of walls 10*a*, 10*b* and 10*c*. Coil spring 12 is secured at one end of channel 10 by a fixed anchor unit 14, which may be a pin or rivet and which is suitably connected near the extremity of channel 10 through drilled holes in sidewalls 10*a* and 10*c*. The opposite extremity of coil spring 12 is connected to a floating anchor member 16 having an extremity 18 through which the free extremity of the coil spring is connected. Anchor member 16 has a central opening 20 therein and a closed extremity 22 at the end of opening 20 opposite extremity 18. Extremity 22 of floating anchor member 16 has a suitable aperture 24 therein. Positioned in the opening 20 of anchor member 16 is a plural grooved roller unit 26 which is journalled on a pin 28. The roller unit 26 has a plurality of grooves 30 therein over which the cord 32 of the balance unit will extend. The extremity of channel member 10 opposite fixed anchor unit 14 mounts a second fixed anchor unit or member 34 formed of a pair of parallel sides which are held together in assembled relationship by means of a grooved roller unit 36 and a stud member 38 which secures together the sides of fixed anchor unit 34. A plural grooved roller unit 36 is rotatably mounted on a journal shaft 40 which may be a rivet. The entire side plate assembly is connected to the channel unit 10 through a rivet 42 which is anchored to the side plates through apertures in the side plates to anchor the plates against longitudinal movement but allows slight pivotal movement or rocking of the plates.

Balance cord 32 is connected at extremity 18 of floating anchor member 16 through aperture 24 and is secured thereto by means such as a knot with the cord extending over the grooved surfaces of roller unit 26 and roller unit 36 in an arrangement which covers 2½ loops with the free extremity of cord 32 extending from the end of the channel member 10 beyond and below grooved roller unit 36 of fixed anchor unit 34. The free end of the cord carries a hook member 46 secured to the end of the cord by suitable means such as a knot. Cord member 32 will preferably be made of a cloth material or nylon and the rollers of the floating anchor 16 and the grooved roller unit 36 preferably are made of suitable metal or plastic such as nylon. Hook member 46 is connected to a window sash in the conventional manner.

In order to provide a friction drag against cord 32, a pin or rivet 50 is held in sidewalls 10*a* and 10*c* above the rear wall 10*b* of channel 10 and between second fixed anchor unit 34 and floating anchor unit 16. Rivet 50, which may be a conventional rivet, is located near fixed anchor unit 34 in an area which will not interfere with the movement of floating anchor unit 16 as it approaches fixed anchor unit 34 when the window is in its closed position. There are multiple lengths of loops of cord 32 in frictional contact with rivet 50 to provide a drag on cord 32.

Rivet 50 may be made of aluminum, brass, steel or other metal and is very cheap in cost.

Thus, this invention relates to a cheap friction drag means working against multiple loops of cord to extend the range of weights of windows that can be balanced with window balances.

The description of the invention has been focussed on the window balance assembly per se as the invention may be used in a wide variety of window balance assemblies of the spring and tackle type. Such window balance assemblies are discussed in such prior art U.S. Pat. Nos., such as; Re. 27,135, 3,358,403, 3,358,404, 3,440,683, and 3,676,956. The window balance assembly of the present invention may be installed in window assemblies shown in the above cited patents and so the specific window assemblies are not shown and described in this specification.

It will be understood that the present embodiment of the invention is to be considered in all respects as illustrative and not restrictive, the scope of the invention being indicated by the scope of the appended claims.

I claim:

1. In a friction controlled window balance comprising a U-shaped channel member with a single coil spring positioned therein and anchored to a fixed anchor unit at one extremity of said channel member, said U-shaped channel having a rear wall and two upstanding side walls, said side walls being integrally connected along respective longitudinal edges of said rear wall, a floating anchor connected to the other extremity of said coil spring and having a plural groove roller unit journalled therein, a second fixed anchor unit having a plural grooved roller unit journalled therein, and a balance cord connected to said floating anchor unit and to said second fixed anchor unit, and wound alternatively in loops around journalled roller units of said floating and second fixed anchor units in the grooves therein, the improvement comprising a non-resilient friction drag element located between said second fixed anchor unit and said floating anchor unit and being in constant frictional contact with multiple lengths of loops of said cord, said friction drag element being connected to and spanning said two upstanding side walls.

2. In a friction controlled window balance as recited in claim 1 in which said U-shaped channel has at least two parallel spaced sidewalls and said friction drag element is a nonrotatable rivet secured between said sidewalls of said U-shaped channel member.

3. In a friction controlled window balance as recited in claim 1 in which said friction drag element is located in front of the rear wall of aid U-shaped channel member.

* * * * *